United States Patent [19]

Boshold

[11] 4,165,627

[45] Aug. 28, 1979

[54] METHOD AND APPARATUS FOR CLOSING THE END OF AN EXTRUDED TUBE SUBMERGED IN WATER

[75] Inventor: Raymond F. Boshold, Springfield, Pa.

[73] Assignee: Wean United, Inc., Pittsburgh, Pa.

[21] Appl. No.: 822,575

[22] Filed: Aug. 8, 1977

[51] Int. Cl.[2] ..... B21C 23/08; B21C 35/04

[52] U.S. Cl. ..... 72/48; 72/255; 72/256; 72/265; 72/370

[58] Field of Search ..... 72/253, 254, 255, 256, 72/264, 265, 367, 370, 48, 38; 29/414; 264/96; 53/477

[56] References Cited

U.S. PATENT DOCUMENTS

| | | | |
|---|---|---|---|
| Re. 25,570 | 5/1964 | Lemelson | 425/465 |
| 1,859,753 | 5/1932 | Summey | 72/255 |
| 2,005,306 | 6/1935 | Wallis | 72/338 X |
| 2,469,975 | 5/1949 | McCloy | 53/477 |
| 3,243,984 | 4/1966 | Hoffmann et al. | 72/255 |
| 3,263,465 | 8/1966 | Way et al. | 72/48 |
| 3,296,847 | 1/1967 | Gettig | 72/256 |
| 3,358,062 | 12/1967 | Lemelson | 53/140 X |
| 3,792,144 | 2/1974 | Burkett et al. | 264/96 |
| 3,814,783 | 6/1974 | Dardaine et al. | 53/140 X |
| 3,913,207 | 10/1975 | Frey | 29/414 X |

FOREIGN PATENT DOCUMENTS

| | | | |
|---|---|---|---|
| 554832 | 2/1957 | Belgium | 72/367 |
| 2457780 | 6/1976 | Fed. Rep. of Germany | 72/264 |
| 598973 | 10/1959 | Italy | 72/255 |

*Primary Examiner*—Francis S. Husar
*Assistant Examiner*—D. M. Gurley
*Attorney, Agent, or Firm*—Daniel Patch; Suzanne Kikel

[57] ABSTRACT

In the direct extrusion of tubing wherein the extruded tube or tubing is immediately submerged into water after extrusion and having a closed leading end, the trailing end thereof in the extrusion press is sealed off from the entrance of water by a crimping device consisting of a tool having a rounded front end which engages and forces through the operation of a piston cylinder assembly one wall inwardly of the trailing end against an opposed wall to form a collapsed double wall cross section.

11 Claims, 9 Drawing Figures

METHOD AND APPARATUS FOR CLOSING THE END OF AN EXTRUDED TUBE SUBMERGED IN WATER

BACKGROUND OF THE INVENTION

Figure 1:
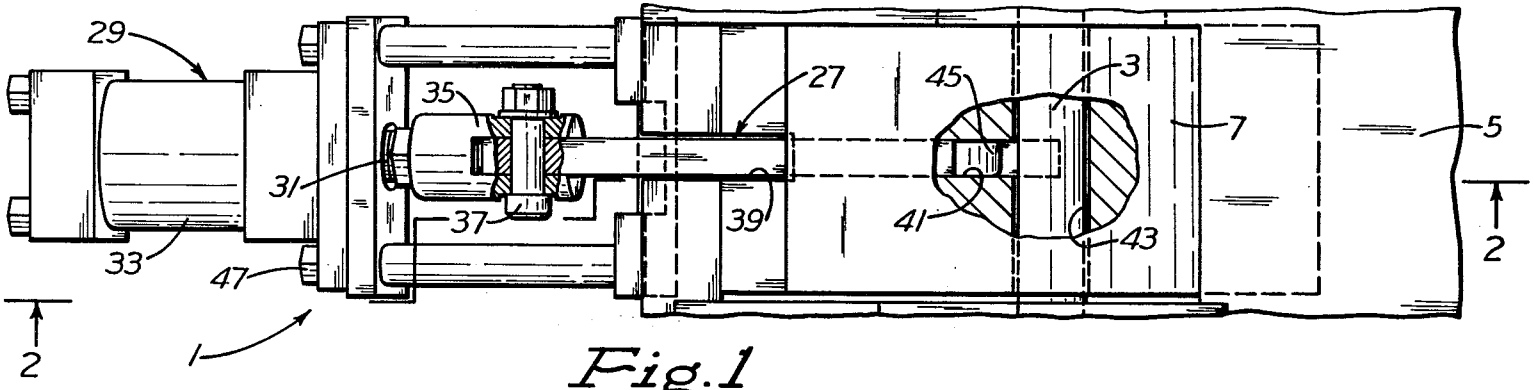

The present invention relates particularly to direct extrusion of a hollow elongated workpiece such as metal tube or tubing, and particularly to a method and apparatus for sealing the trailing end thereof to prevent water from entering the inside of the tubing while being completely submerged in water after the extruding process.

In present day tube extrusion practice it is becoming highly desirable to subject extruded non-ferrous tubing, such as copper tubing, to water treatment since the water temperatures can be easily maintained to accelerate the cooling process to keep grain growth and oxidation of the extruded product to a minimum.

However, the entrance of water into the inside diameter of the tubing creates several problems, such as drainage and safety problems since the water drains onto the plant floor. In addition to this, employees handling the tubing during subsequent operations are continually subjected to the draining water. Also, subsequent drawing operations of the tubing are hampered by the presence of water and saw chips inside the tubing.

In order to overcome these hazards and disadvantages, it has become common practice to close both the leading and trailing ends of the tubing prior to the water treatment.

One common method practiced in extruders using a floating constant diameter mandrel, is to pierce, at the beginning of the extrusion stroke, a billet to within a short distance of the die to first produce a short section of solid rod. The mandrel is then inserted into the die for the completing of the extrusion process; however, shortly before the end of the extrusion stroke the mandrel is retracted out of the tube and die and again a short piece of rod is extruded. Since the mandrel has a constant diameter and the dummy block has a hole slightly greater than the outer diameter of the mandrel a seal is maintained between the outer diameter of the mandrel and the hole in the dummy block, thereby enabling the ram to extrude this short piece of rod.

Problems arise, however, when an arrested mandrel is used. Such mandrels are stepped having a large shank and a reduced diameter tip for extruding small tubing. When the stepped mandrel is withdrawn from the die and tube, the tip enters the dummy block hole. Under this condition when the main ram is brought forward to close the trailing end of the tube it is quite likely that the metal will extrude backwards into the hole of the dummy block as well as forward through the die. Even with precise dimensioning of the mandrel tip, and a very fine manipulation of the mandrel and ram it is virtually impossible to overcome this occurrence.

It is, therefore, an object of the present invention to overcome the above disadvantages of the prior method of extrusion particularly using a stepped mandrel by providing a method and apparatus for closing the trailing end of the tubing just after the end of the extrusion stroke.

It is another object of the present invention to provide a method which can be practiced in conjunction with an apparatus which can be used on original equipment or added to existing presses.

More particularly, an object of the present invention is to provide a method and apparatus for crimping the trailing end of a tubing prior to the trailing end being submerged in water.

It is a still further object of the present invention to provide a method used in combination with a machine for producing a hollow elongated workpiece wherein in the production of the workpiece the leading end thereof has a closed end, the steps comprising: completing the remainder of the production of the workpiece including the trailing end thereof, and before the hollow trailing end portion is exposed, deforming a hollow portion of the workpiece inward of the trailing end in a manner to close off the trailing end.

A still further object of the present invention is to provide an apparatus used in combination with a machine for producing a hollow elongated workpiece, wherein in the production of the workpiece the leading end thereof has a closed end, an apparatus comprising: means for operating said machine to produce the remainder of the workpiece including the trailing end thereof, and means operable before the hollow trailing end of the workpiece is exposed for deforming a hollow portion of the workpiece inward of the trailing end in a manner to close off the trailing end.

Figure 2:
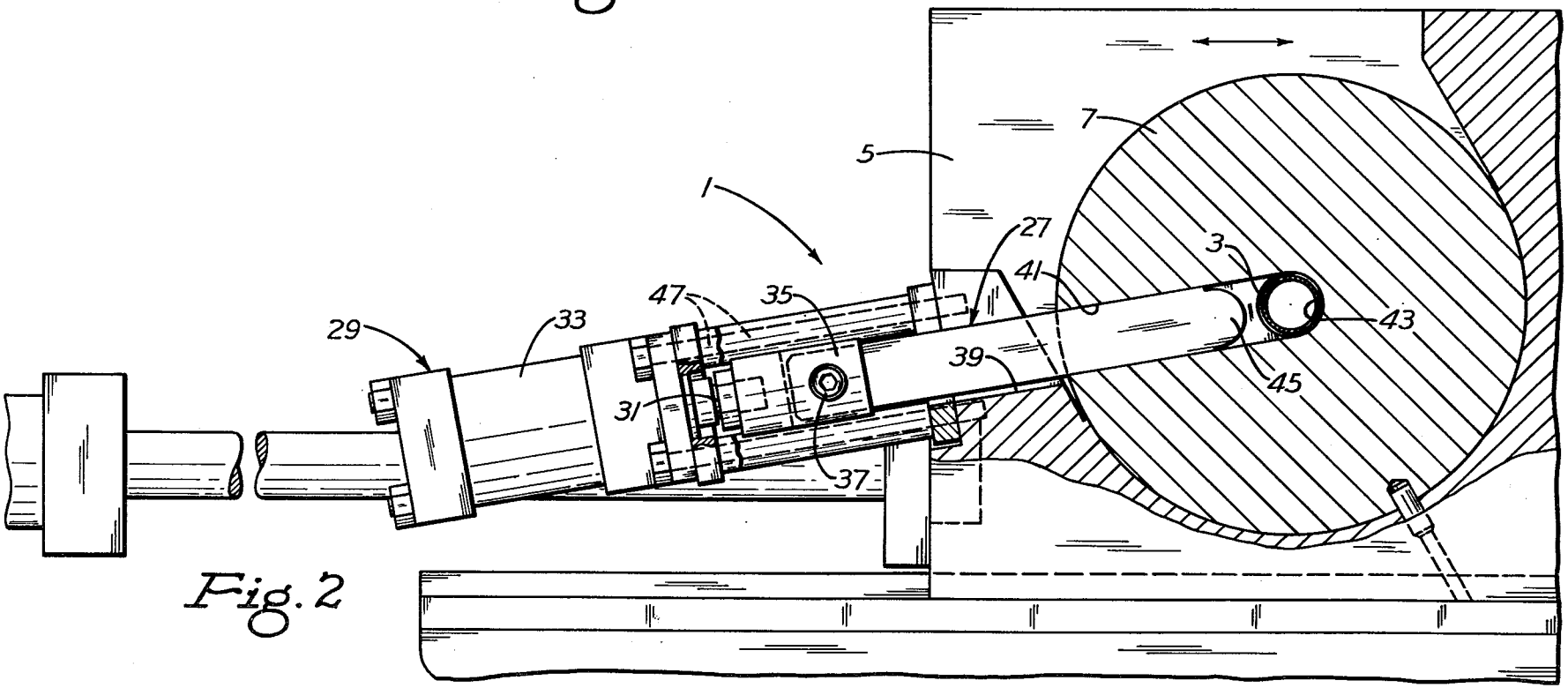
Figure 5:
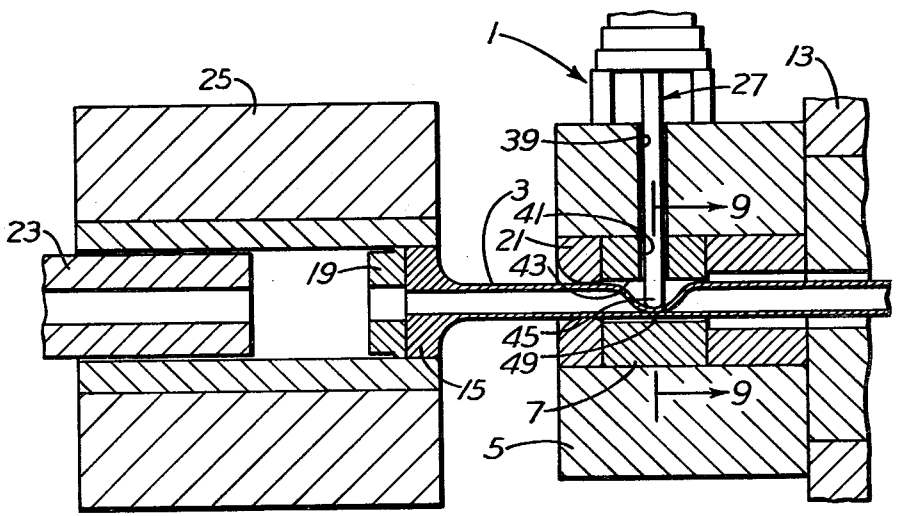
Figures 6, 7, 8, 9:
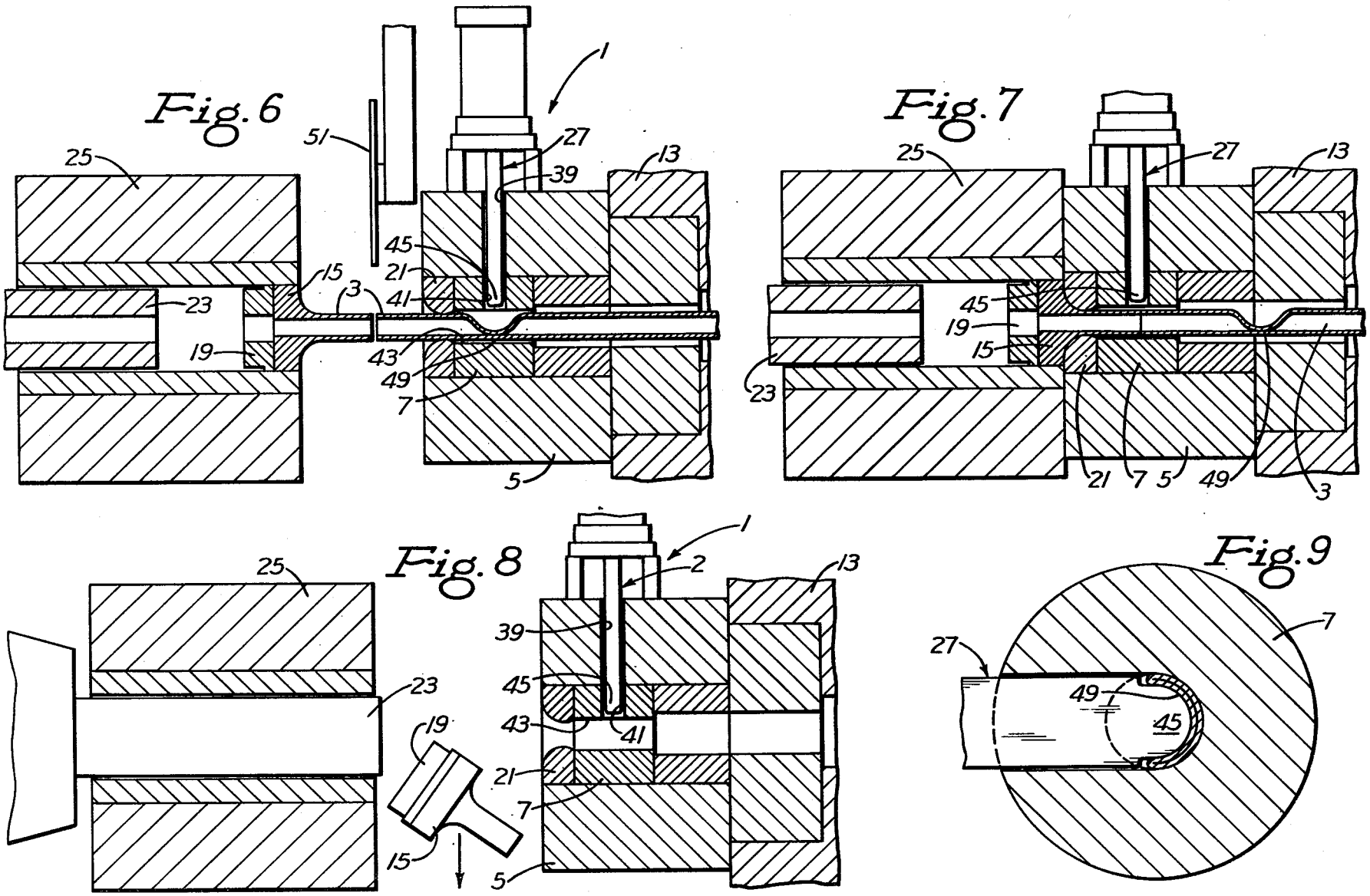

These objects, as well as other novel features and advantages of the present invention, will be better understood and appreciated when the following description is read along with the accompanying drawings, of which:

FIG. 1 is a plan view of the crimping device partly broken away for clarity incorporating the features of the present invention, FIG. 2 is an elevational partly sectional view of the crimping device taken along lines 2—2 of FIG. 1;

FIGS. 3–8, along with better illustrating the various components of an extrusion press, illustrate the location of the present invention and the steps involved in achieving the present invention; and FIG. 9 is a sectional view taken along lines 9—9 of FIG. 5.

Since the construction and operation of extrusion presses for direct extrusion are well known in the art, only some of its principal components will be referred to to the extent necessary for one to appreciate and understand the present invention.

Figure 3:
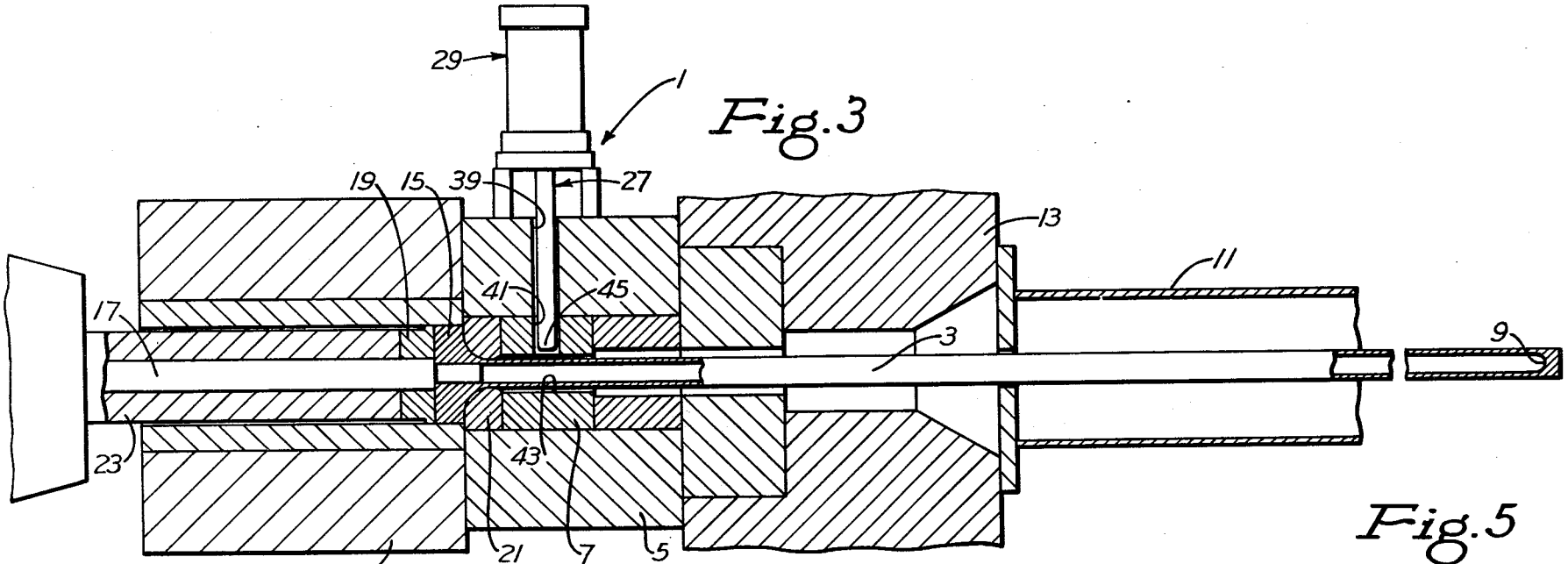

Referring first to FIG. 3, crimping device 1 is in an inoperative position perpendicularly to tubing 3, a portion of which is located within die slide 5 and bolster 7. As can be seen, the extruded portion of tubing 3, having a closed front end 9 exits the extrusion press and enters a water tank 11 located adjacent to and mounted on platen 13 of the press. At this final stage of the extrusion process, tubing 3 is extruded to form a butt end 15. An arrested, stepped mandrel 17 having a portion in dummy block 19 and its reduced diameter tip in die 21 and in the unextruded butt end 15 is to be retracted along with the stem 23, from container 25, more about which will be said later.

Referring now to FIGS. 1 and 2, crimping device 1 is mounted to a wall of die slide 5 which supports bolster 7. The crimping device 1 consists of an elongated rounded tool 27 reciprocated or displaced by a piston cylinder assembly 29. The one end of the tool 27 is connected to an end of a piston rod 31 in cylinder 33 through clevis 35 in which tool 27 is fastened by bolt and nut 37. This arrangement provides for easy and quick removal and replacement of tool 27, particularly when the die slide 5 is moved to an inoperative position away from the press to change the die 21. Die slide 5 and bolster 7 have cooperating openings 39 and 41 for receiving displaceable tool 27. These openings 39 and 41 communicate with and are located perpendicularly to another opening 43 in bolster 7 through which tubing 3 extends. Tool 27 has a reduced rounded front end 45 relative to its diameter portion as best shown in FIG. 9. The crimping device 1 is securely mounted to die slide 5 by four bolts 47 equally spaced around and running parallel to piston rod 31 and tool 27. When it is desirable to close or seal the trailing end of the tubing 3, the piston cylinder assembly 29 is activated to reciprocate tool 27 in openings 39 and 41 and toward the tubing 3 wherein the front end engages and forces one longitudinal wall of tubing 3 against the other longitudinal wall supported by the inside diameter of opening 43 in bolster 7. Since the material of tubing is hot and malleable, only a small force is required to accomplish this crimping action which appears in exaggerated form in FIG. 9.

Figure 4:
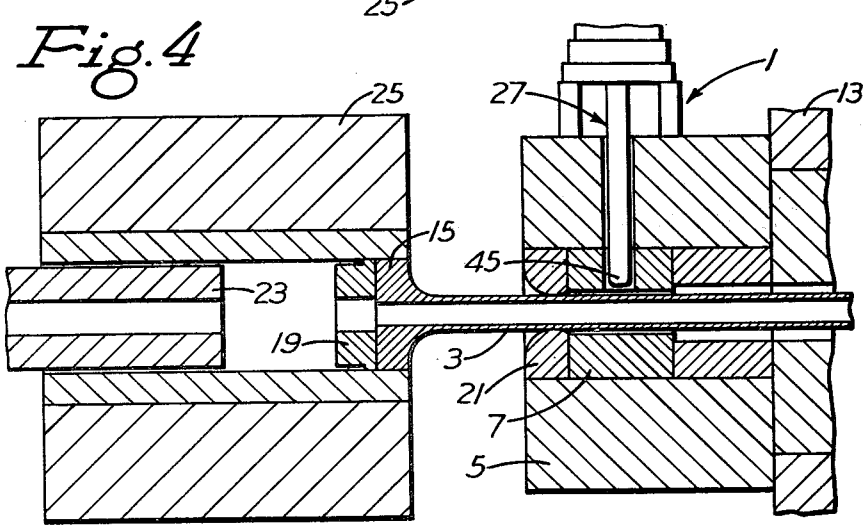

As mentioned, FIGS. 3–8 illustrate the location of crimping device 1 and gives a step-by-step procedure for closing the trailing end of an extruded copper tubing at the end of an extrusion stroke. Referring particularly to FIG. 3, copper tubing is first extruded to form a desired butt end 15. While tubing 3 is being extruded, tool 27 is held by the piston cylinder assembly 29 out of opening 43 away from tubing 3. The extruded tubing whose front end has already been closed by the process mentioned earlier, extends through the extrusion press and into water tank 11. Next, as shown in FIG. 4, the mandrel 17 is retracted fully out of the container 25, while the stem 23 is retracted partially in the container 25. The container 25 along with the dummy block 19 and butt end 15 are then moved away from the die 21, thereby exposing a length of tubing between the container 25 and the die 21. FIG. 5 shows the crimping step which involves the front end of the tool 45 of crimping device 1 which is best shown in FIG. 2 located radially to the tubing, which tool 45 is reciprocated in openings 39 and 41 of die slide 5 and bolster 7, respectively, by piston cylinder assembly 29 to crimp the walls of tubing together to close the trailing end 49. This effect of creating a collapsed double wall cross section as mentioned is better shown in FIG. 9. The next step is to saw or shear the exposed length between the container 25 and die 21.

FIG. 6 illustrates the positioning of a saw 51 radially of the tube to perform this step. After the severing is completed, the saw 51 is retracted, and the container 25 is moved toward the die 21. As shown in FIG. 7, this movement of the container 25 with the butt end 15, causes the butt to contact the tubing 3 to push the extruded tubing out of the die 21 and into the bolster 7. FIG. 8 illustrates the final step wherein the extruded tubing has been removed from the die assembly and platen 13 and is completely submerged in water in water tank 11. Here, the container 25 is moved away from the die 21 over the stem 23 causing the stem to push both the butt end 15 and the dummy block 19 out of the container.

By the above described method and operation of the crimping device, it can be seen that a water tight seal can be accomplished for the trailing end of an extruded tubing in accordance with the objects of the present invention.

It is to be noted that the crimping device 1 has been designed in such a way that merely by changing the bolster 7 and the crimping tool 27 the trailing end of any diameter tubing within the capabilities of the press force can be closed.

In accordance with the provisions of the patent statutes, I have explained the principle and operation of my invention and have illustrated and described what I consider to represent the best embodiment thereof.

I claim:

1. In combination with a machine such as an extrusion press for producing a first portion of a hollow elongated workpiece of finite length such as an extruded metal tubing and a water tank for receiving and treating said hollow elongated workpiece, wherein in the production of the workpiece the leading end thereof has a closed end so that water is prevented from entering inside of the workpiece when said workpiece enters said water tank, the steps comprising:

completing the remainder of the production of the workpiece including the trailing end thereof and before the hollow trailing end portion exits the press, deforming a hollow portion of the workpiece at a point inward of the open trailing end in a manner to close off the hollow portion of the workpiece at said inward point from the open trailing end, from the entrance of water.

2. In combination with a machine according to claim 1, wherein the deforming step further comprises:

crimping a longitudinal wall of the tubing radially inwardly toward the opposed longitudinal wall of the tubing.

3. In combination with a machine according to claim 1, the steps further comprising:

sawing or shearing the trailing end of the tubing after deforming in a manner that the trailing end remains closed and the tubing can be removed from the press.

4. In combination with an extrusion press having a die, container, mandrel and stem for extruding metal tubing wherein in the production of the tubing the leading end thereof has a closed end so that water is prevented from entering the inside of the tubing, the steps comprising:

completing the remainder of the production of the workpiece including the trailing end thereof in a manner that a butt end is formed at the extruded trailing ends of the tubing in the container, retracting the mandrel and stem away from the die to allow for retraction of the butt end away from the die, moving the container away from the die so that the butt end is pulled away from the die to expose a length of tubing between the container and die, crimping a longitudinal wall of the tubing radially inwardly toward the opposed longitudinal wall of the tubing in a manner to close off the trailing end, and sawing or shearing the tubing to separate the butt end from the tubing.

5. In combination with a machine according to claim 4, the steps further comprising:

advancing the container and butt end to push the extruded tubing out of the die, and moving the container and die away a second time to effect an ejecting of the butt end from the container.

6. In combination with a machine such as an extrusion press for producing a first portion of a hollow elongated workpiece of a finite length such as an extruded metal tubing and a water tank for receiving and treating said hollow workpiece, wherein in the production of the workpiece the leading end thereof has a closed end so that water is prevented from entering the inside of the workpiece when said workpiece enters said water tank, means for operating said machine to produce the remainder of the workpiece including the trailing end thereof, and means operable before the hollow trailing end of the workpiece exits the press for deforming a hollow portion of the workpiece inward of the trailing end in a manner to close off the hollow portion of the workpiece at said inward point from the open trailing end.

7. In combination with a machine according to claim 6 wherein said deforming means comprises:

a crimping device so constructed and arranged to engage and force one longitudinal wall of said tubing against an opposed longitudinal wall thereof.

8. In combination with a machine, according to claim 7, wherein said crimping device comprises:

a guided displaceable tool arranged perpendicularly relative to said tubing, and means for displacing said tool toward and away from said tubing.

9. In combination with a machine such as an extrusion press having a bolster and die slide for producing a hollow elongated workpiece of a finite length such as an extruded metal tubing and a water tank for receiving and treating said hollow workpiece wherein in the production of the workpiece the leading end thereof has a closed end so that water is prevented from entering the inside of the workpiece when said workpiece enters said water tank comprising:

means for operating said machine to produce the remainder of the workpiece including the trailing end thereof, and a crimping device having a displaceable member operable before the hollow trailing end of the tubing exits the press for forcing one longitudinal wall of said tubing against the opposed longitudinal wall in a manner to close the trailing end.

10. In combination with a machine according to claim 9 wherein said bolster and die slide (have cooperating openings) each have an opening cooperating relative to each other and said combination includes means for arranging said displaceable member to extend into said openings of said bolster and said die slide, and means for mounting said displaceable member and an actuating means therefore on said die slide for movement therewith.

11. In combination with a machine according to claim 10, wherein said displaceable member consists of a tubing deforming end so constructed to form a double walled collapsed cross section in a portion of said tubing, said bolster having a second opening cooperating with the first opening thereof for receiving said tubing and being constructed so that the portion of said bolster opposite said first opening serves as a support for said tubing during the deforming thereof.

* * * * *

UNITED STATES PATENT AND TRADEMARK OFFICE

CERTIFICATE OF CORRECTION

PATENT NO. : 4,165,627

DATED : August 28, 1979

INVENTOR(S) : Raymond F. Eoshold

It is certified that error appears in the above—identified patent and that said Letters Patent is hereby corrected as shown below:

Column 6, Claim 10, lines 15 and 16, delete "have cooperating openings"

Signed and Sealed this

*Fourth* Day of *March 1980*

[SEAL]

*Attest:*

SIDNEY A. DIAMOND

*Attesting Officer*

*Commissioner of Patents and Trademarks*